US005918423A

United States Patent [19]

Ponder

[11] Patent Number: 5,918,423

[45] Date of Patent: Jul. 6, 1999

[54] WIND SPOILER RIDGE CAPS FOR SHALLOW PITCHED GABLED ROOFS

[76] Inventor: Henderson F. Ponder, P.O. Box 145, Summerville, Ga. 30747

[21] Appl. No.: 08/802,031

[22] Filed: Feb. 18, 1997

Related U.S. Application Data

[60] Provisional application No. 60/029,523, Oct. 31, 1996.

[51] Int. Cl.[6] ..... E04B 7/18

[52] U.S. Cl. ..... 52/57; 52/58; 52/24; 52/173.1

[58] Field of Search ..... 52/57, 58, 84, 52/24, 173.1, 198, 43, 749.12, 746.11, 199

[56] References Cited

U.S. PATENT DOCUMENTS

| | | | |
|---|---|---|---|
| 417,270 | 12/1889 | Nelson | 52/57 |
| 431,463 | 7/1890 | Hewitt | 52/57 |
| 493,344 | 3/1893 | Vance | 52/57 |
| 2,270,537 | 1/1942 | Ludington | 52/173.1 |
| 2,270,538 | 1/1942 | Ludington | 52/15 |
| 3,313,069 | 4/1967 | Jackson | 52/24 |
| 3,828,498 | 8/1974 | Jones | 52/173.1 |
| 4,005,557 | 2/1977 | Kramer et al. | 52/173.1 |
| 5,706,618 | 1/1998 | Pratt | 52/57 X |
| 5,713,158 | 2/1998 | Gibbs | 52/57 |

*Primary Examiner*—Carl D. Friedman
*Assistant Examiner*—Laura A. Callo

[57] ABSTRACT

A system of wind spoiler ridge row caps designed to spoil the airfoil effect of wind blowing over the top of buildings having shallow pitched gabled roofs, in order to minimize damage to, and prevent the lifting off of such shallow pitched gabled roofs by force of strong winds.

3 Claims, 2 Drawing Sheets

WIND SPOILER RIDGE CAPS FOR SHALLOW PITCHED GABLED ROOFS

Applicant claims benefit from co-pending provisional patent application titled "WIND SPOILER RIDGE ROW CAPS FOR SHALLOW PITCHED GABLED ROOFS" application Ser. No. 60/029,523—date filed Oct. 31, 1996.

BACKGROUND OF THE INVENTION

This invention relates in general to buildings having shallow pitched gabled roofs, and relates in particular to the harmful effect strong winds have on such buildings, and further to the use of wind spoiler ridge row caps designed to minimize the damage often caused to such buildings.

It is a well known fact that billions of dollars in damages to buildings is caused each year from the devastating effect of strong winds, especially along the sea coast of the southern part of the United States. It is further known that much of the damage is due to the haphazard architectural design utilized in many of the buildings. These buildings range in style from the very steep pitched A-frame to the extremely shallow pitched bungalow, and all styles are prevalent along the sea coast where the strongest winds are experienced.

Wind tunnel test show that shallow pitched gabled roofs reacts to wind much like the wing of an airplane. As wind blows over the roof it hugs close to the surface. It travels up the windward side, makes a shallow downward turn at the top and continues downward, creating a vacuum along the surface of the lee plane of the roof Consequently, the roof is often lifted off, and the building destroyed.

SUMMARY OF INVENTION

Therefore, it is an object of the present invention to provide a system of wind spoiler ridge row caps, designed to spoil the airfoil effect of wind blowing over the leeward surface of a shallow pitched gabled roof.

It is another object of the present invention to provide a system of wind spoiler ridge row caps that can be easily attached to both new, and old buildings alike.

To prove that lift is created by the curved top of an airfoil when no wind passes beneath, roll the end of a sheet of typing paper around a pencil. Hold the end with the pencil against your tin and blow air across the top. As you can see, the lee end of the paper will lift even with p small amount of wind.

DESCRIPTION OF THE PRESENT INVENTION

The present invention proposes to provide a system of wind spoiler ridge rowcaps which can be easily attached to the ridge row of a shallow pitched gabled roof for the purpose of spoiling the airfoil effect of wind blowing over the roof, and preventing the roof from blowing off by force of strong winds.

Figure 1:
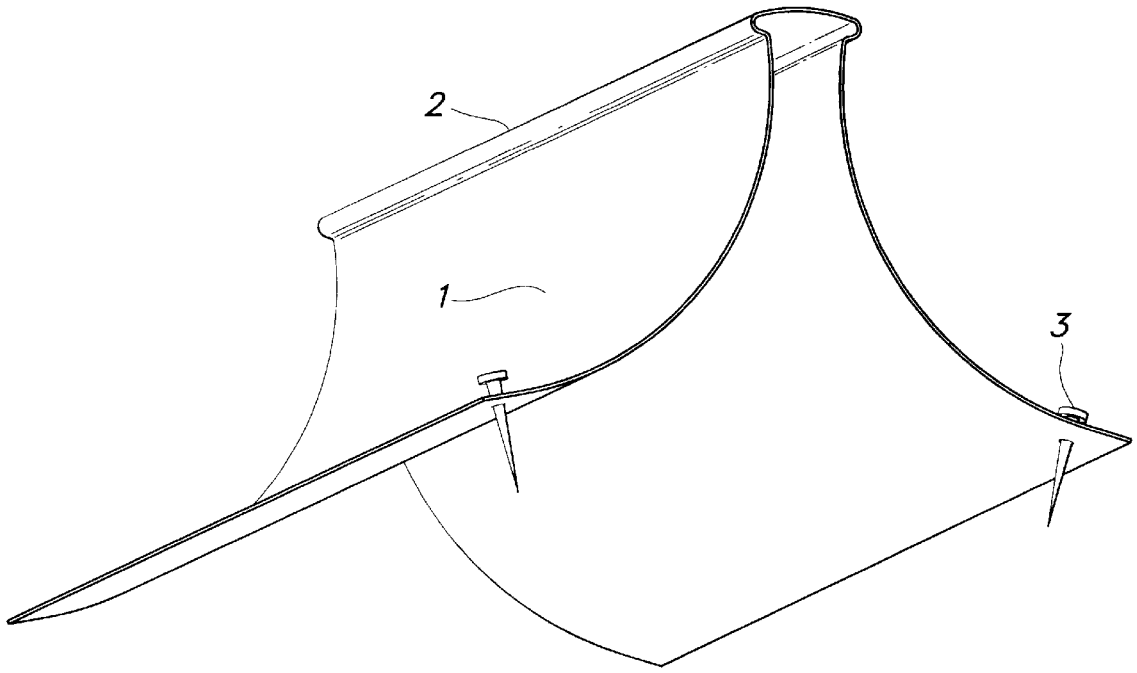
FIG. 1 shows a pictorial view of a section of the wind spoiler ridge row caps of the present invention.

Turn now to FIG. 1, where there is shown generally a pictorial view of a section of the wind spoiler ridge row caps of the present invention. It will be noted, as indicated at 1, that the walls of the caps rise in a curved pattern, starting with a shallow pitch at the bottom and ending in a very steep pitch at the top. At 2 there can be seen a small lip protruding outwards and then back to form the slightly curved top of the cap. Of course, the other side of the cap is formed in the same fashion. It will be noted that the cap sections are overlapped and nailed, or fastened with screws as indicated at 3, and as shown in the drawing at FIG. 2. Also, a bonding strip of tar or other such material is recommended along the underside of the caps so that heat from the sun will bond the caps together.

It should be noted that the purpose of the wind spoiler caps as described in FIG. 1 above is to lift the flow of wind sharply upward by means of the upwardly curved walls of the cap, and then to cause a critical disturbance in the flow as the wind comes into contact with the outwardly protruding lip at the top. This rapid change in the direction of the wind will tend to break the air bubble and spoil the airfoil effect of the roof as the wind travels across the lee plane of the roof.

Figure 2:
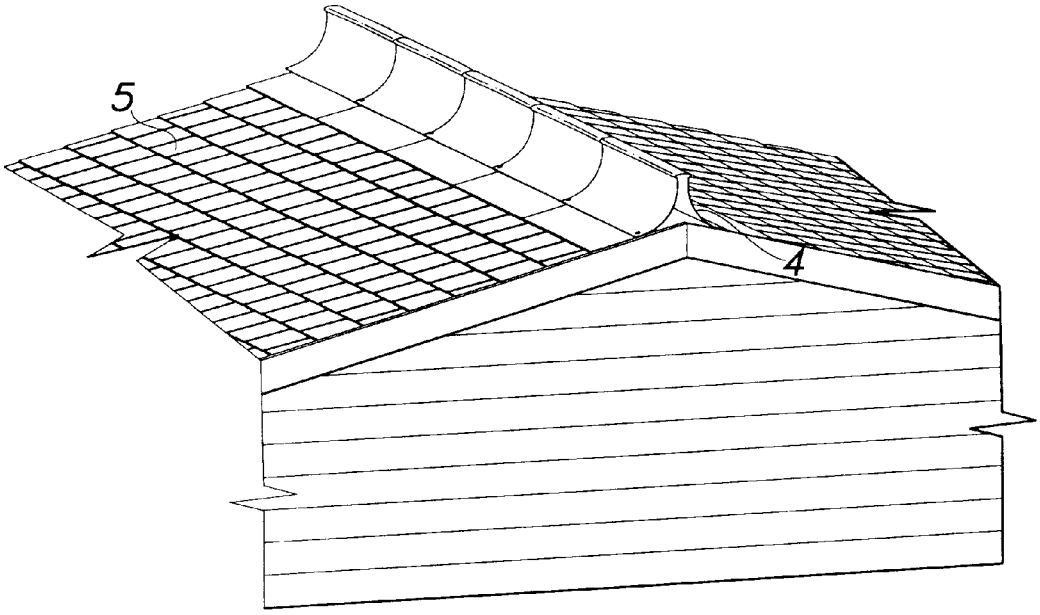
FIG. 2 shows a pictorial view of a shallow pitched gabled roof capped with sections of the wind spoiler ridge row caps of the present invention.

A brief look at FIG. 2 will show that the wind spoiler ridge row caps of the present invention, indicated at 4, will serve to improve the looks of a typical shallow pitched gabled roof Especially when the caps are made to match the shingles of the roof, indicated at 5, in both color and texture.

Figure 3:
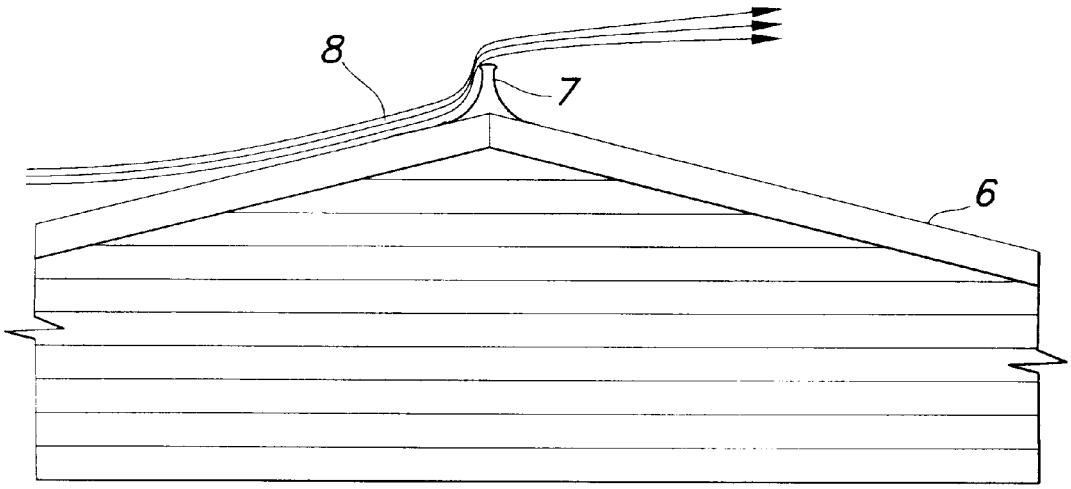
FIG. 3 shows a cross section of a typical shallow pitched gabled roof utilizing the wind spoiler ridge row caps of the present invention and the wind effects thereon.

To further understand the concept, turn next to FIG. 3 where there is shown generally at 6 a cross section of a shallow pitched gabled roof, at 7 the end view of a section of the wind spoiler ridge row caps of the present invention, and at 8 a number of lines indicating the direction of wind blowing over the roof from left to right. As can be seen, when wind travels up the windward slope of the shallow roof, it comes into contact with the sharply pitched ridge row which is constructed with the wind spoiler ridge row caps of the present invention. Consequently, the airfoil effect is spoiled; the air bubbles at the ridge row break, and no lift is created.

It should be noted that the wind spoiler ridge row caps could be constructed in many different shapes without departing from the spirit and scope of the present invention, so long as said caps are designed to force the flow of wind blowing across a shallow pitched gabled roof upwards in a manner that will spoil the airfoil effect of said shallow pitched roof.

Furthermore, it will be obvious that the wind spoiler ridge row caps of the present invention could be manufactured in sections of any desired length, so long as adequate means for fastening the caps to the roof in a leak-free fashion is provided. However, it should further be obvious that the caps should be constructed from strong, rigid materials.

Finally, it would be desirable that the caps be coated, and/or colored to match the texture and color of the material with which the building is roofed.

Although the disclosed embodiment of the present invention finds utility in a system of wind spoiler ridge row caps designed to minimize the damage often caused by strong winds to buildings having shallow pitched gabled roofs, it should be understood that the foregoing relates only to a disclosed embodiment, and numerous changes and modifications may be made therein without departing from the spirit and scope of the present invention as defined in the following claims.

Wherefore, the following is claimed:

1. A system of wind spoiler ridge row caps for buildings with shallow pitched gabled roofs, comprising ridge row caps constructed of metal or other rigid materials having a pair of outwardly sloping side walls which form an inverted V-shaped ridge, each said wall having a lower end and an upper end, wherein said walls of said caps are designed to fasten over the ridge row of a roof with one said wall of said caps extending downward to be attached at said lower end to one side of said roof, and the other said wall of said caps extending downward to be attached at said lower end to the other side of the roof, wherein the walls of the caps extend from said lower end in a continuous progressively curved fashion to said upper end where said walls of said caps turn sharply outward to form a lip, or protrusion, at an upper end of said caps, and then turn back in the opposite inwardly direction to form a slightly rounded top of the caps.

2. The wind spoiler ridge row caps of claim 1 wherein the progressively curved walls of said caps will cause the lower layer of wind blowing over said roof to turn upwards in order to separate said wind from the lee plane of said roof.

3. The wind spoiler ridge row caps of claim 1 wherein the lip, or protrusion at the upper end of said caps will cause the lower layer of wind blowing over said roof to boil, or roll sharply back in the opposite direction to break the air bubble and spoil the airfoil effect of said roof.

* * * * *